US006357800B1

(12) United States Patent
Müller et al.

(10) Patent No.: US 6,357,800 B1
(45) **Date of Patent: *Mar. 19, 2002**

(54) DOCUMENT WITH A MOIRE-GENERATING RASTER STRUCTURE

(75) Inventors: Johann Müller, Poing; Stefan May, Munich, both of (DE)

(73) Assignee: Giesecke & Devrient GmbH, München (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/068,019

(22) PCT Filed: Sep. 1, 1997

(86) PCT No.: PCT/EP97/04745

§ 371 Date: Oct. 5, 1998

§ 102(e) Date: Oct. 5, 1998

(87) PCT Pub. No.: WO98/09825

PCT Pub. Date: Mar. 12, 1998

(30) Foreign Application Priority Data

Sep. 3, 1996 (DE) ..... 196 35 761

(51) Int. Cl.[7] ..... B42D 15/00

(52) U.S. Cl. ..... 283/93; 283/72; 356/374; 358/454; 358/533

(58) Field of Search ..... 283/72, 91, 93; 356/374; 358/454, 533

(56) References Cited

U.S. PATENT DOCUMENTS

| | | | | | |
|---|---|---|---|---|---|
| 15,486 | A | * | 8/1856 | Hannay | 283/72 |
| 4,040,353 | A | * | 8/1977 | Lefebvre | 283/93 |
| 4,582,346 | A | * | 4/1986 | Caprio et al. | 283/93 |
| 4,618,523 | A | * | 10/1986 | Yoshida | 283/91 |
| 5,074,597 | A | * | 12/1991 | Mancuso et al. | 283/91 |
| 5,374,976 | A | * | 12/1994 | Spannenburg | 283/72 |
| 5,732,163 | A | * | 3/1998 | Brandstetter et al. | 382/296 |
| 5,808,758 | A | * | 9/1998 | Solmsdorf | 359/2 |
| 5,987,221 | A | * | 11/1999 | Bearss et al. | 395/109 |

FOREIGN PATENT DOCUMENTS

| | | |
|---|---|---|
| EP | 0 204 552 | 12/1986 |
| EP | 0 353 974 | 2/1990 |

* cited by examiner

*Primary Examiner*—A. L. Wellington
*Assistant Examiner*—Monica Carter
(74) *Attorney, Agent, or Firm*—Bacon & Thomas

(57) ABSTRACT

A data carrier with at least one halftone images 10 represented by structural elements 12, whereby a predetermined symmetrical widening of structural elements 12 represents a corresponding gray level of halftone image 10. Image 10 has predetermined areas 14, 16 and 22 each having a predetermined number or screen frequency of structural elements 12, the screen frequency of structural elements 12 per unit area of area 14, 16 and 22 being different between at least two areas 14, 16 and 22 and/or structural elements 12 being offset from each other in at least two areas 14, 16 and 22. A data carrier with such a halftone image 10 acquires a moiré pattern in at least predetermined areas of halftone image 10 when copied, so that a copy of the data carrier is recognizable immediately and with the naked eye (FIG. 1).

21 Claims, 6 Drawing Sheets

DOCUMENT WITH A MOIRE-GENERATING RASTER STRUCTURE

BACKGROUND OF THE INVENTION

1. Field of the Invention

The present invention relates to a data carrier, for example a document of value, with at least one halftone image represented by structural elements, each structural element having a basic geometry and a size whereby the size of the structural element represents a gray level of the halftone image, and to a method for producing the same. The invention further relates to a data carrier, for example a document of value, with at least one picture element represented by one or more structural elements.

2. Related Art

A special problem with documents, such as documents of value, is the protection from forgery, in particular by copying or scanning an authentic document to produce a falsified document. For example, EP 0 710 574 A2 relates to a security document with a drawing whereby a moire pattern arises in the corresponding drawing on a copy of the security document. For this purpose a whole-area screen structure with parallel lines is provided. The drawing is done in the form of a half-tone image, the thicknesses of the lines being varied in a contact screen structure as described in EP 0 085 066 B1. Further, the distance between the lines is varied over the entire halftone image in accordance with a modulation function. That is, the number of lines per unit length varies over the total surface of the drawing. Modification of such a line density leads to copy protection against color copiers or scanners since the superimposition of the screen structure at least in a predetermined area with the scanning screen of the copier or scanner produces a very striking moire pattern. Since this moire pattern can be seen only on the copy, not on the original, the copy is easily identifiable as a forgery.

Although there is a moire effect at least in predetermined areas through the variation of line density even with different scanning screens of the scanner, the variation of line density over the total surface of the drawing has an extremely adverse effect on the optical appearance of the half-tone image. The alternation between high and low density or number of lines per unit area causes the picture to seem restless and inhomogeneous and the screen pattern to dominate the halftone image rather than vice versa, so that the picture is not very appealing esthetically.

BRIEF SUMMARY OF THE INVENTION

The present invention is therefore based on the problem of providing a document with a-moire-producing structure, in particular on a halftone image, whereby large-surface moire structures are produced upon copying of the document for detecting forgeries, the moire-producing structure simultaneously fitting homogeneously into the halftone image and receding as a background structure relative to the halftone image itself.

The invention is based on the idea of dividing the total surface of a picture in which moire structures are to be produced upon copying into a plurality of areas. Each area has associated therewith a number of structural elements for producing the gray levels present in this area. The number of structural elements is selected in at least two contiguous areas so as to be different in the two contiguous areas. This different number results necessarily in an offset of the structural elements relative to the structural element of the adjacent area. Thus, the halftone image applied to the data carrier is divided into areas which have different screen frequencies. Upon an attempt to copy this halftone image or read it into a data processing system with a scanner, the scanning frequency of the scanner or copier is superimposed with the applied, different screen frequencies of the half-tone image. This superimposition leads to disturbances in the reproduction of the halftone image, this disturbance being apparent in particular in the production of a large-surface moiré pattern.

The variation of the number of structural elements in the areas of the halftone image produces a different screen frequency for each area, thereby ensuring that a moiré pattern arises even when the scanning screen, i.e. the scanning or copying frequency, is varied. This then appears in the areas of the total surface for which the scanning and screen frequencies are coordinated with each other such that a moiré pattern can arise.

According to the invention the image thus has predetermined areas each having a predetermined number of structural elements, the number of structural elements per unit area of an area being different between at least two contiguous areas and/or the structural elements being offset from each other in at least two of the areas. This has the advantage that disturbances such as moiré patterns arise even with different scanning screens, for example of a copier or scanner, without inhomogeneities arising in the total surface screen, in particular in the halftone image.

In a preferred embodiment the structural elements of an area of the halftone image have a uniform basic geometry, it being particularly preferable for the structural elements of all areas to have a uniform basic geometry. The structural elements are preferably executed as lines, a predetermined thickness of a line representing a predetermined gray tone separately for each area. This makes it possible to ensure a homogeneous brightness level over the total gray-level image despite the gray-level image being divided into a plurality of areas with different numbers of structural elements. If for example n structural elements are present in a first area and n+10 structural elements in the adjacent area, the second area would appear optically darker than the first area solely due to the increased number of structural elements. This difficulty is avoided if a given width of the line corresponds to a given gray tone within one area, while a different, for example smaller, width of the line is provided for the same given gray tone within a second area having a higher number of lines in this case.

The inventive representation of halftone images by areas with different numbers of structural elements thus achieves the advantage that the halftone image has different screen frequencies which are superimposed with the scanning frequency of a scanner or copier used for scanning the document, and the different screen frequencies produced by the varied number of structural elements per area offer the possibility of superimposing the scanning frequencies with a plurality of screen frequencies, thereby clearly increasing the probability of a moiré pattern forming. Simultaneously the effect of individual areas darkening due to the increased number of structural elements is avoided since the predetermined size of the structural elements corresponds to a predetermined gray tone within an area, but the predetermined sizes of the structural elements in the different areas can represent different gray tones depending on the number of structural elements in each area.

DESCRIPTION OF THE DRAWINGS

Further features, advantages and preferred embodiments of the present invention can be found in the subclaims and the following description of the figures, in which:

FIG. 1 shows an enlarged detail rendition of a portrait represented according to the present invention as a halftone image with a moiré-producing structure. Halftone image 10 is divided into different column-like strips 14, 16, 22 each having a number of structural elements 12. In the present embodiment there are 23 strips, whereby this number can also be selected higher or lower. Each strip 14, 16, 22 has associated therewith a number of linear structural elements 12 forming a screen structure in each column. Halftone image 10 is represented by linear structural elements 12, a certain line thickness corresponding to a certain gray tone of halftone image 10 in each area.

Figure 1:
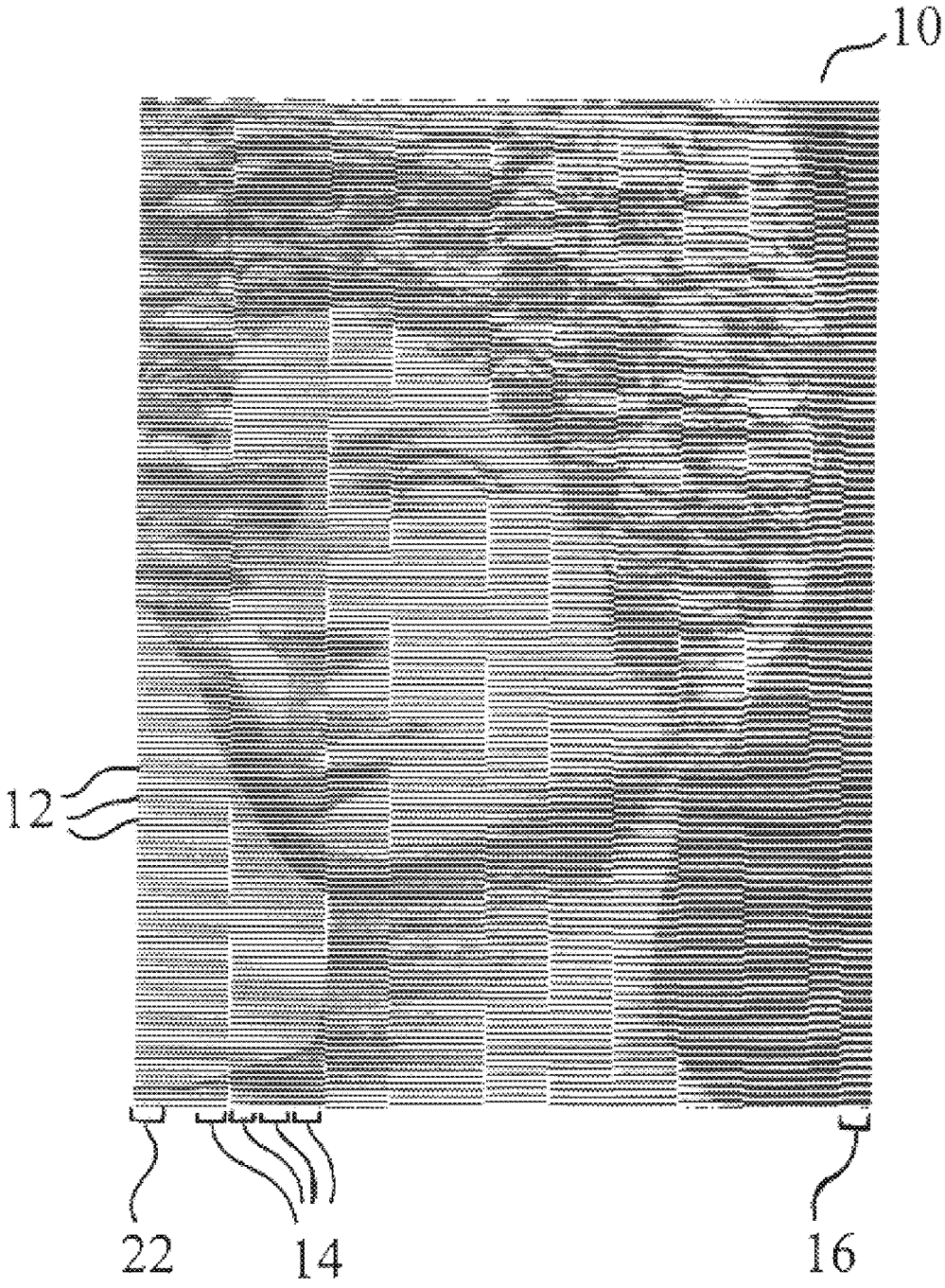
FIG. 1 shows an enlarged representation of a halftone image with a moiré-producing structure according to a first embodiment of the present invention.
Figure 2A:
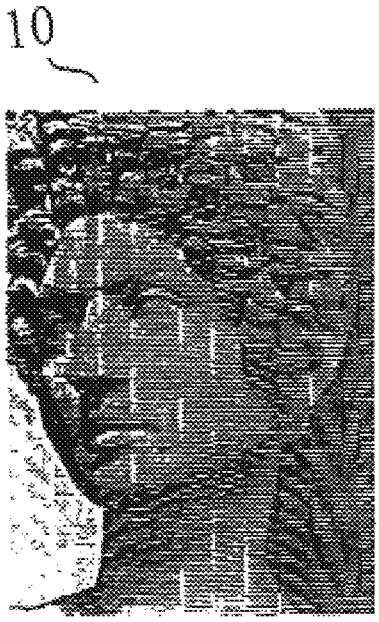
FIGS. 2*a* to 2*d* show several attempted copies of the inventive halftone image of FIG. 1.
Figure 2B:
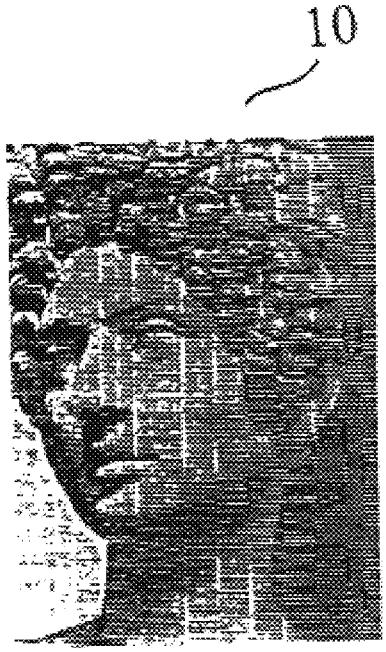
Figure 2C:
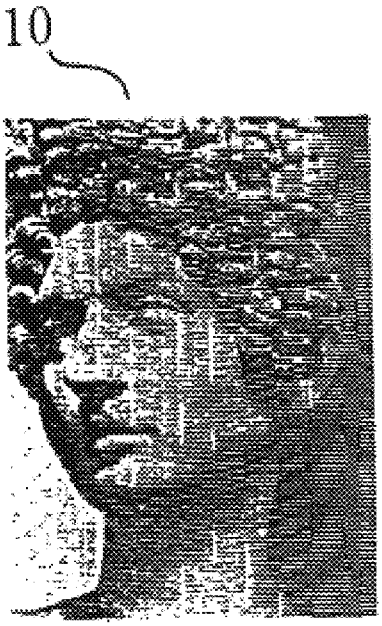
Figure 2D:
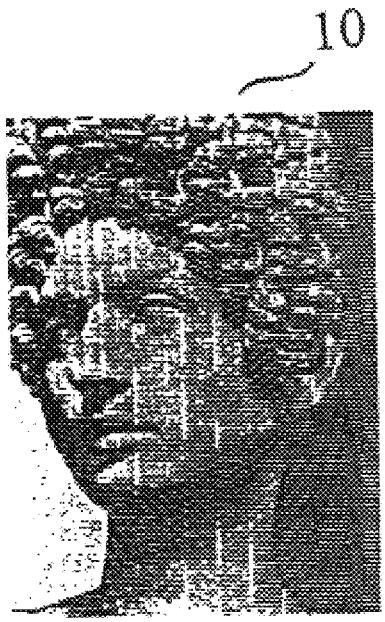

Within column or strip 14, 16, 22 vertical linear structural elements 12 can vary in their screen width and/or angular position and/or modulation.

Each strip 14, 16, 22 contains a predetermined number of structural elements 12, i.e. a predetermined number of lines based on the total portrait height. The line density is for example 20 lines per cm in first strip 16. First strip 16 comprises 118 lines in the shown embodiment. This number of lines increases from strip to strip so that last strip 22 is present with 171 lines in the shown preferred embodiment.

Since all strips of the portrait shown in FIG. 1 have the same height, a different number of lines means a different screen frequency for each strip. As shown in FIG. 1, the screen frequency increases from the right to the left in accordance with the increased number of structural elements 12 in each strip. This results in a somewhat different screen frequency in each of the 23 strips, whereby at least one screen frequency or at least one predetermined number of screen frequencies produces a clearly visible, striking moiré pattern upon scanning or copying due to the superimposition with the scanning frequency of the scanner or copier.

This achieves an effective copy protection of a document provided with image 10 according to FIG. 1, whereby the varied number of structural elements 12 in different areas 14, 16 and 22 does not adversely affect the halftone image or can be used additionally, for example to emphasize edges or corners.

In the example according to FIG. 1 the structural elements used are straight lines widened symmetrically to represent a certain halftone so that a certain thickness of the line can be associated with a predetermined gray tone in each area. The lines are formed perpendicular to the division of the areas and can emphasize corners and edges of the halftone image in particular when the areas are selected such that abutting areas extend along such a corner or edge.

It is possible to represent the structural elements not only by lines but also using other geometrical basic forms, if such as curves, points, circles or the like.

Although the areas have the same width and virtually the same surface area, as shown in FIG. 1, the halftone image can also be divided into areas of different forms or widths and different surface areas. It is in addition possible to vary the basic geometry and/or orientation of the structural elements within two, preferably contiguous, areas. This covers even more widely the different scanning frequencies of the scanners or copiers used. The distances between the structural elements within one area can be constant or vary, as shown in FIG. 1, it being in particular preferred to vary the distances according to a given function. Further, a plurality of different arrangements of the structural elements ensures that even if the scanning frequency of a scanner or for example a color copier happens to coincide with a screen structure of certain strip 14 so that no moiré pattern is produced, a moiré pattern will nevertheless arise with at least one other screen structure of another area 16, 22 upon copying. Thus, a moiré pattern will arise at least on partial areas of a reproduction even when the document is scanned at different angles.

In especially advantageous fashion, columns 14, 16, 22 are spaced a predetermined distance apart. This makes the moiré-producing structure fit in more homogeneously since direct contact of the moiré-producing structure of adjacent strips 14, 16, 22 leads to abrupt transitional jumps which are optically very striking. This has a very adverse effect on the optical appearance of halftone image 10.

FIGS. 2*a* to 2*d* illustrate attempted copies of the halftone image of FIG. 1 with different adjustments of the copier. As indicated directly by FIGS. 2*a* to 2*d*, different moire patterns arise at different places in halftone image 10 upon copying at different scanning angles, but a moiré pattern emerges clearly in some form at least in partial areas of halftone image 10 in every attempted copy. This makes immediately and clearly recognizable in a copy of the image of FIG. 1 compared to the original of FIG. 1 that a forgery has been done by copying or scanning.

Figure 3:
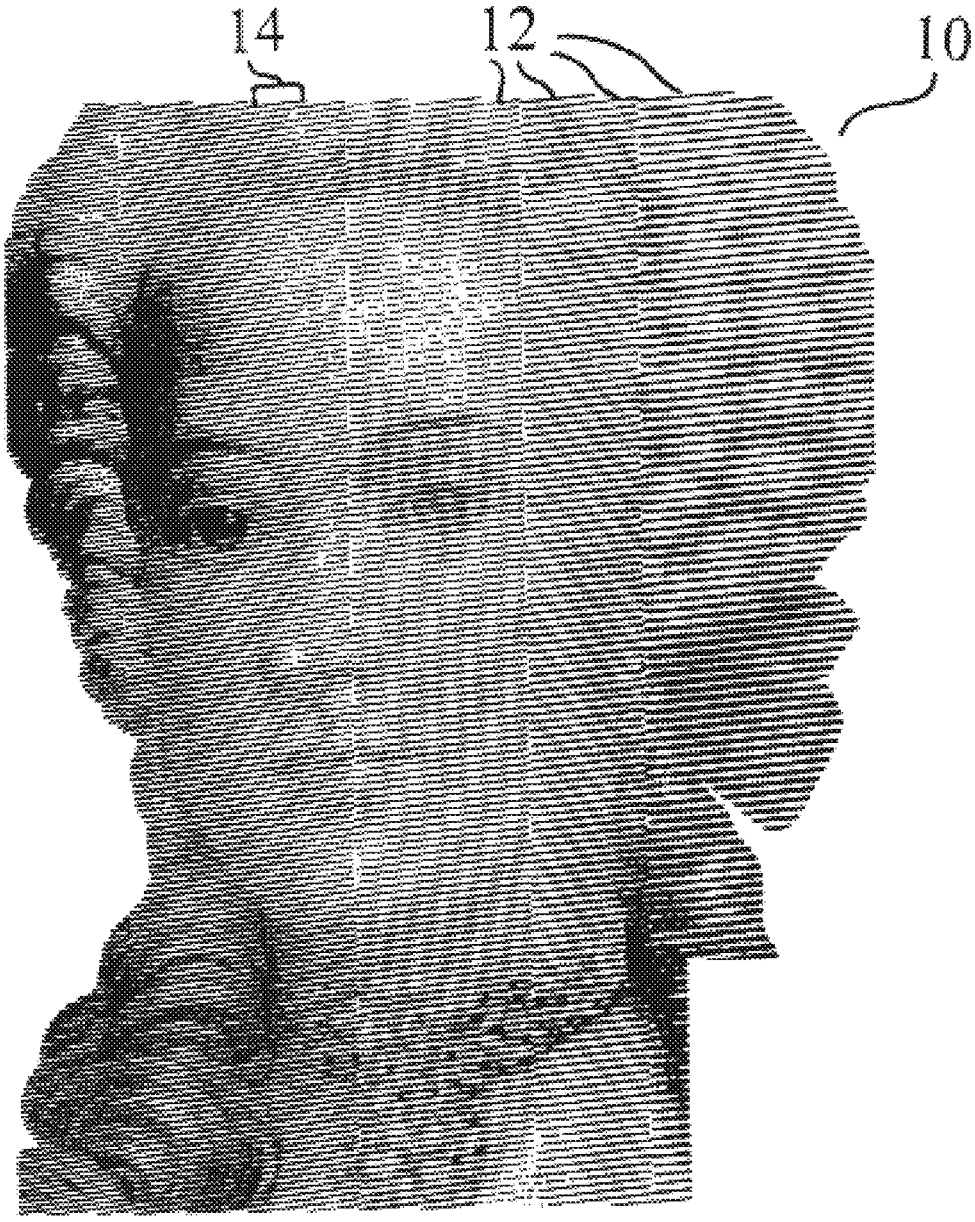
FIG. 3 shows an enlarged representation of a halftone image with a moiré-producing structure according to a second embodiment of the present invention.

FIG. 3 shows an enlarged representation of a halftone image with a moiré-producing structure according to a second embodiment of the present invention. This embodiment corresponds to the first embodiment shown in FIG. 1, the difference being that structural elements 12 in areas 14 are not disposed perpendicular to the division of areas 14, as in the first embodiment of FIG. 1, but slightly tilted from the perpendicular of the division into columns.

Figure 4A:
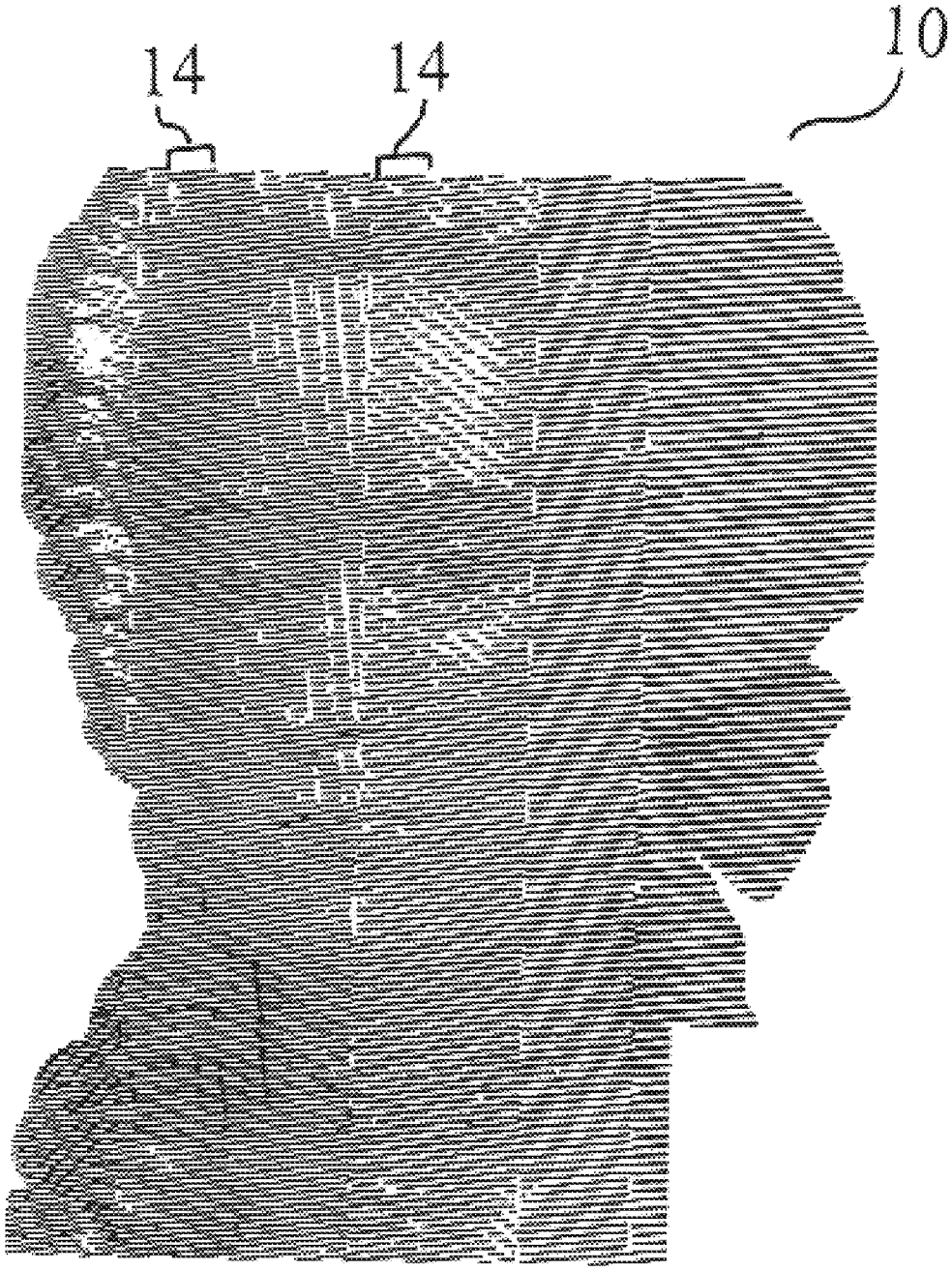
FIGS. 4*a* to 4*b* show two attempted copies of the inventive halftone image of FIG. 3.
Figure 4B:
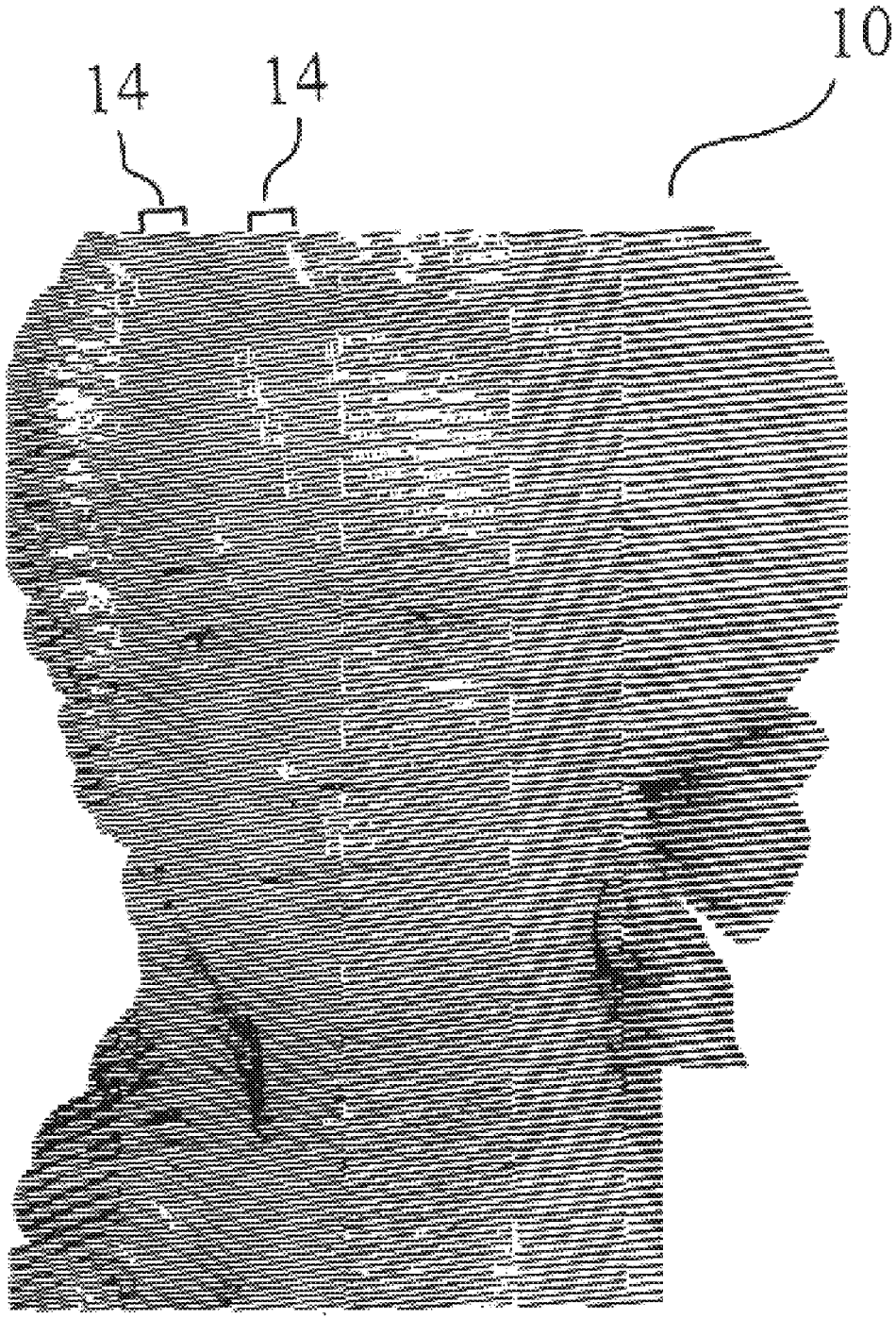

FIGS. 4*a* and 4*b* show two attempted copies of the halftone image of FIG. 3. As clearly indicated by FIGS. 4*a* and 4*b*, the scanning process during copying causes very striking moiré patterns. FIGS. 4*a* and 4*b* differ by a different scanning angle during copying of the halftone image of FIG. 3. It is readily evident that different moiré patterns arise in different areas 14 with different scanning screens during the copying operation. Even without direct comparison with the halftone image of FIG. 3 it is recognizable immediately and with the naked eye that FIGS. 4*a* and 4*b* are not original images but copies.

A further advantageous embodiment of the moiré-producing screen in halftone image 10 is to vary the tilting angle of structural elements 12 additionally within halftone image 10. This prevents a production of moire during the copying operation from being reduced or possibly prevented by a suitable choice of the scanning angle during copying. In this connection it is pointed out that the copier need not have any special devices for realizing the copy protection of the present invention. Further, it is excluded that a copying operation be performed so as to prevent the formation of moiré structures on copies by adapting the scanning screen of the copier to the moiré-producing structure. The moiré-producing structure according to the present invention responds to every copying operation of any kind by making very striking moiré patterns arise on the copy which are visible and recognizable with the naked eye and expose the copy as such immediately.

Figure 5:
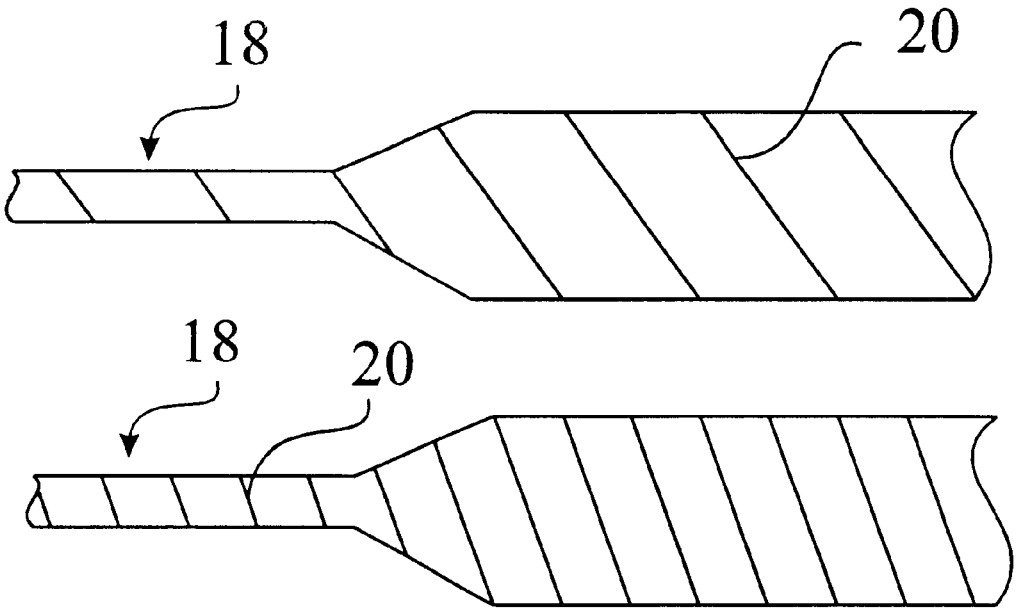
FIG. 5 shows an enlarged representation of two structural elements shown according to a third advantageous embodiment of the present invention.

FIG. 5 shows an enlarged representation of two structural elements 18 analogous to structural elements 12 of FIG. 1 but specially executed according to a third advantageous embodiment. Structural elements 18 themselves have screen lines 20 which produce a screen structure within structural element 18. This screen structure itself can also have a color modulation for producing a picture motif. The tone formed by screen lines 20 can be realized in particular very well by steel printing since the depth of the steel printing is a measure of the color saturation so that it is possible to adjust the tone of structural element 18 via screen lines 20.

It is of course possible to combine the two embodiments of FIGS. 1 and 3 with the third embodiment of FIG. 5 such that structural element 12 of the embodiment of FIGS. 1 or 3 is represented according to structural element 18 of the embodiment of FIG. 5.

Although it might happen that a moiré pattern arising upon copying is not recognizable with the naked eye in the second embodiment according to FIG. 5, deviations of the screen structure produced by screen lines 20 between the original and the copy are visible with a magnifying glass so that forgeries are clearly identifiable.

Although halftone image l0is divided into areas 14 in longitudinal columns in the shown embodiments of FIGS. 1 and 3, it is quite within the scope of the present invention to form areas 14 as any surfaces, preferably also without a predetermined geometrical form such as square, rectangle, triangle or the like. At least two contiguous surface areas of any shape differ according to the invention by the number of structural elements, such as lines, in a particular surface area and/or by the orientation of the structural elements in a surface area and/or by the form of the structural elements in the particular surface area, such as lines in the form of straight lines, waves, guilloches or the like. This new technique makes it possible to prevent attempts at scanning or copying, or to recognize the scanned or copied objects clearly as reproductions.

The inner surfaces of a guilloche pattern can also be used as surface areas for example. The formation of a moiré pattern upon copying is then produced or ensured within these surfaces by variation of the angles, variation of the lines per unit area and/or by variation of the type of line.

Variations of the preferred embodiments described above may be made by a person skilled in the art without departing from the scope of the appended claims.

What is claimed is:

1. A data carrier such as a document of value, with at least one halftone image (10) represented by structural elements (12, 18), each structural element having a basic geometry and a size wherein the size ofthe structural element (12, 18) represents a gray level of the halftone image (10), and wherein the halftone image (10) has contiguous first and second contiguous areas, anumber of structural elements per unit area of said first contiguous areabeing different than a number of structural elements per unit area of said second contiguous area, wherein said number of structural elements per unit area of said first contiguous area equals a screen frequency of said first contiguous area and a number of structural elements per unit area of said second contiguous area equals a screen frequency of said second contiguous area, said screen frequency of the first contiguous area thereby being different than a screen frequency of the second contiguous area.

2. The data carrier of claim 1, wherein all structural elements (12, 18) of at least one area (14, 16, 22) have a uniform basic geometry.

3. The data carrier of claim 2, wherein the predetermined sizes of the structural elements consists of a predetermined symmetrical widening of their basic geometry.

4. The data carrier of claim 1, wherein the structural elements (12, 18) are lines.

5. The data carrier of claim 4, wherein all lines (12, 18) forming the halftone image (10) are aligned essentially in the same direction at least within one area (14, 16, 22).

6. The data carrier of claim 4, wherein the lines (12, 18) are aligned essentially perpendicular to the division of the halftone image areas (14, 16, 22).

7. The data carrier of claim 1, wherein predetermined size of a structural element (12, 18) corresponds to a predetermined gray level within an area (14, 16, 22).

8. The data carrier of claim 1, wherein the halftone image (10) is printed on the data carrier.

9. The data carrier of claim 1, wherein the data carrier is selected from the group consisting of a bank note, ID card, and chip card.

10. The data carrier of claim 1, wherein the areas (14, 16, 22) are strips disposed in columns each with a predetermined width.

11. The data carrier of claim 10, wherein all strips (14, 16, 22) have the same predetermined width.

12. The data carrier of claim 1, wherein all areas (14, 16, 22) have the same surface area.

13. The data carrier of claim 1, wherein at least the orientation of the structural elements (12, 18) differ from each other in at least two contiguous areas (14, 16, 22).

14. The data carrier of claim 1, wherein the predetermined screen frequency of the structural elements (12, 18) is selected such that a moiré pattern is produced when the data carrier is scanned with a scanner.

15. The data carrier of claim 1, wherein the predetermined areas (14, 16, 22) are spaced a predetermined distance apart.

16. A data carrier of claim 1, comprising at least one picture element represented by one or more of said structural elements (18), wherein the structural elements (18) are represented by means of screen lines (20) forming a screen structure.

17. The data carrier of claim 16, wherein the screen structure is represented by means of a number of screen lines (20) which are essentially parallel within a structural element (18).

18. The data carrier of claim 17, wherein the number of screen lines (20) is different between at least two structural elements (18).

19. A method for producing a data carrier, for example a document of value, with at least one halftone image (10) represented by structural elements (12, 18), the structural elements having a basic geometry, and a predetermined size of the structural elements (12, 18) representing a gray level of the halftone image (10), comprising the following steps:

a) dividing a halftone image original into at leasttwo contiguous areas (14, 16, 22), b) associating a number of structural elements each having a screen frequency (12, 18) with each area (14, 16, 22), the screen frequency of the structural elements (12, 18) being different in at least two contiguous areas (14, 16, 22), c) associating the halftones present in an area with a structural element (12, 18) of defined size, d) applying the halftone image of the document by applying the at least two areas (14, 16, 22) with the particular associated structural elements (12, 18) in the sizes corresponding to the halftones.

20. The method of claim 19, wherein the structural elements are printed using steel intaglio printing.

21. The method of claim 19, wherein the structural elements are applied by means of a number of screen lines.

* * * * *